US006419790B1

(12) United States Patent
Leege et al.

(10) Patent No.: US 6,419,790 B1
(45) **Date of Patent: *Jul. 16, 2002**

(54) METHODS OF MAKING AN ULTRA SOFT, HIGH BASIS WEIGHT TISSUE AND PRODUCT PRODUCED THEREBY

(75) Inventors: Joseph C. Leege, Neenah; Ranga Ramesh, Appleton, both of WI (US)

(73) Assignee: Fort James Corporation, Atlanta, GA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/917,684

(22) Filed: Aug. 26, 1997

Related U.S. Application Data

(63) Continuation of application No. 08/467,110, filed on May 9, 1996, now abandoned.

(51) Int. Cl.[7] ..... D21H 11/00; B21F 1/12

(52) U.S. Cl. ..... 162/112; 162/113; 162/123; 162/127; 162/128; 162/158

(58) Field of Search ..... 162/109, 111, 162/112, 113, 123, 158, 127, 128

(56) References Cited

U.S. PATENT DOCUMENTS

| | | | |
|---|---|---|---|
| 3,554,862 | A | 1/1971 | Hervey et al. |
| 3,554,863 | A | 1/1971 | Hervey et al. |
| 3,620,911 | A | 11/1971 | Eklund et al. |
| 3,844,880 | A | 10/1974 | Meisel, Jr. et al. |
| 4,064,213 | A | 12/1977 | Lazorisak et al. |
| 4,094,718 | A | 6/1978 | Czerwin |
| 4,304,625 | A | 12/1981 | Grube et al. |
| 4,501,640 | A | 2/1985 | Soerens |
| 4,528,316 | A | 7/1985 | Soerens |
| 4,684,439 | A | 8/1987 | Soerens |
| 4,720,383 | A | 1/1988 | Drach et al. |
| 4,795,530 | A | 1/1989 | Saoerens et al. |
| 4,883,564 | A | 11/1989 | Chen et al. |
| 4,886,579 | A | 12/1989 | Clark et al. |
| 5,102,501 | A | 4/1992 | Eber et al. |
| 5,145,737 | A | 9/1992 | Boiron et al. |
| 5,223,096 | A | 6/1993 | Phan et al. |
| 5,225,047 | A | 7/1993 | Graef et al. |
| 5,246,544 | A | 9/1993 | Hollenberg et al. |
| 5,262,007 | A | 11/1993 | Phan et al. |
| 5,281,307 | A | 1/1994 | Smigo et al. |
| 5,312,522 | A | 5/1994 | Van Phan et al. |
| 5,320,710 | A | 6/1994 | Reeves et al. |
| 5,354,425 | A | 10/1994 | Mackey et al. |
| 5,374,334 | A | 12/1994 | Sommese et al. |
| 5,382,323 | A | 1/1995 | Furman, Jr. et al. |
| 5,399,241 | A | 3/1995 | Oriaran et al. |
| 5,409,572 | A | 4/1995 | Kershaw et al. |
| 5,415,737 | A | 5/1995 | Phan et al. |

FOREIGN PATENT DOCUMENTS

| | | |
|---|---|---|
| EP | 404189 | 6/1990 |
| EP | 495637 | 1/1992 |
| EP | 496524 | 1/1992 |
| EP | 0675225 | 10/1995 |
| EP | 707945 | 10/1995 |
| EP | 743172 | 11/1996 |

OTHER PUBLICATIONS

Kajaani Electronics Ltd., *The Significance of Coarseness in Papermaking*, Kajaani, Finland, 1986.

*Primary Examiner*—Peter Chin
(74) *Attorney, Agent, or Firm*—Finnegan, Henderson, Farabow, Garrett & Dunner, L.L.P

(57) ABSTRACT

The present invention is a method of making an ultra soft, multi-ply tissue using wet press technology and the product produced thereby.

22 Claims, 3 Drawing Sheets

METHODS OF MAKING AN ULTRA SOFT, HIGH BASIS WEIGHT TISSUE AND PRODUCT PRODUCED THEREBY

This application is a continuation of application Ser. No. 08/647,110, filed May 9, 1996, now abandoned.

FIELD OF THE INVENTION

The present invention relates to a method of making an ultra soft, multi-ply tissue having a high basis weight using wet press technology. More particularly, the invention relates to an ultra soft bathroom tissue produced using wet press technology.

BACKGROUND OF THE INVENTION

In the area of bathroom tissue, softness, absorbency and strength are key attributes considered by consumers. It is highly desirable that the tissue product have a consumer perceived feel of softness. This softness plays a key role in consumer preference. Softness relates both to the product bulk and surface characteristics. In addition to softness, the consumer desires a product that is both strong and absorbent to minimize the amount of the product which must be used to do an effective job.

The method of the present invention uses wet press technology to prepare a strong, ultra soft tissue having a high basis weight. The tissue produced by the method of the present invention exhibits good strength and absorbency while remaining extremely soft. Properties such as those exhibited by the tissue produced by the present invention have previously only been seen on products produced by costly Through-Air-Drying (TAD) technology. The tissue according to the present invention has properties like those of the TAD produced tissue but can be formed using more efficient, less expensive wet press technology.

In a conventional wet press process and apparatus (10), as exemplified in FIG. 1, a furnish is fed from silo (50) through conduits (40, 41) to headbox chambers (20, 20'). A web (W) is formed on a conventional wire former (12), supported by rolls (18, 19), from a liquid slurry of pulp, water and other chemicals. Materials removed from the web of fabric by Uhle box (29) through the forming fabric when pressed against forming roll (15) are returned to silo (50), from saveall (22) through conduit (24). The web is then transferred to a moving felt or fabric (14), supported by roll (11) for drying and pressing. Materials removed from the web during drying and pressing are collected in saveall (44) and fed to white water conduit (45). The web is then pressed by suction press roll (16) against the surface of a rotating Yankee dryer cylinder (26) which is heated to cause the paper to substantially dry on the cylinder surface. The moisture within the web as it is laid on the Yankee surface causes the web to transfer to the surface. Liquid adhesive may be applied to the surface of the dryer to provide substantial adherence of the web to the creping surface. The web is then creped from the surface with a creping blade (27). The creped web is then usually passed between calender rollers and rolled up on roll (28) prior to further converting operations, for example, embossing. The action of the creping blade on the paper is known to cause a portion of the interfiber bonds within the paper to be broken up by the mechanical smashing action of the blade against the web as it is being driven into the blade. However, fairly strong interfiber bonds are formed between the wood pulp fibers during the drying of the moisture from the web. The strength of these bonds in prior art tissues is such that even after creping, the web retains a perceived feeling of hardness, a fairly high density, and low-bulk and water absorbency.

To reduce the strength of the interfiber bonds that inevitably result when wet pressing and drying a web from a slurry, various processes have been utilized. One such process is the passing of heated air through the wet fibrous web after it is formed on a wire and transferred to a permeable carrier—a so-called through-air-dried (TAD) process—so that the web is not compacted prior to being dried. The lack of compaction, such as would occur when the web is pressed while on a felt or fabric and against the drying cylinder when it is transferred thereto, reduces the opportunity for interfiber bonding to occur, and allows the finished product to have greater bulk than can be achieved in a wet press process. Because of the consumer perceived softness of these products, and their greater ability to absorb liquids than webs formed in wet press processes, the products formed by the newer processes enjoy an advantage in consumer acceptance.

Felted wet press processes are significantly more energy efficient than processes such as through-air-drying since they do not require heating and moving large quantities of air as required by the TAD process. In wet press operations, excess moisture is mechanically pressed from the web and the final drying of the web is obtained chiefly on the heated Yankee drying cylinder which is maintained at the proper drying temperature.

The present invention provides a method for making a tissue product that achieves high bulk, absorbency and softness above existing conventional wet press technology tissue, approaching or achieving the levels found using through-air-drying while using the cheaper more efficient wet press process.

SUMMARY OF THE INVENTION

Further advantages of the invention will be set forth in part in the description which follows and in part will be apparent from the description. The advantages of the invention may be realized and attained by means of the instrumentalities and combinations particularly pointed out in the appended claims.

To achieve the foregoing advantages and in accordance with the purpose of the invention, as embodied and broadly described herein, there is disclosed:

A method of making an ultra-soft high basis weight multi-ply tissue comprising:

(a) providing a fibrous pulp including 35 to 90% of a first fiber, wherein the first fiber has an average fiber length of 2.0 mm or less and a coarseness of 12 mg/100 meters or less;

and including 10 to 65% of a second fiber having an average fiber length greater than 2.0 mm and a coarseness of less than 35 mg/100 meters wherein the pulp further includes up to about 5 lb/ton of a strength adjusting agent;

(b) forming a first nascent web from the pulp, wherein the first web has a basis weight of at least about 11 lbs/3000 sq. ft. ream;

(c) including in the first web at least about 1.0 lbs/ton of a cationic nitrogenous softener;

(d) dewatering the first web through wet pressing;

(e) adhering the first web to a Yankee dryer;

(f) creping the first web from the Yankee dryer, wherein the adhesion between the first web and the Yankee dryer is controlled to achieve a reel crepe of at least about 20%;

(g) forming a second nascent web as recited in steps (a)–(f) above;

(h) combining the first web with the second web to form a multi-ply web;

(i) wherein either the first and second webs are calendered individually prior to combination into a multi-ply web or the multi-ply web is calendered; and wherein steps (a)–(f), (g) and (i) are controlled to result in a multi-ply tissue product having an MD tensile strength of about 27 to about 38 g/3" width per lb. of basis weight, a CD tensile strength of about 10 to about 23 g/3" width per lb. of basis weight, a caliper of at least about 3 mils/lb. basis weight, a GM MMD friction of less than about 0.190, and a tensile stiffness of less than about 0.72 g/% strain per lb. of basis weight.

There is further disclosed an ultra soft, high absorbency product produced by the above-described method.

There is still further disclosed a method of making an ultra-soft high basis weight multi-ply tissue comprising:

(a) providing a fibrous pulp including 35 to 90% of a first fiber, wherein the first fiber has an average fiber length of 2.0 mm or less and a coarseness of 12 mg/100 meters or less;

and including 10 to 65% of a second fiber having an average fiber length greater than 2.0 mm and a coarseness of less than 35 mg/100 meters wherein the pulp further includes up to about 5 lb/ton of a strength adjusting agent;

(b) forming a first nascent web from the pulp, wherein the first web has a basis weight of at least about 11 lbs/3000 sq. ft. ream;

(c) dewatering the first web through wet pressing;

(d) adhering the first web to a Yankee dryer;

(e) creping the first web from the Yankee dryer, wherein the adhesion between the first web and the Yankee dryer is controlled to achieve a reel crepe of at least about 20%;

(f) forming a second nascent web as recited in steps (a)–(e) above;

(g) combining the first web with the second web to form a multi-ply web;

(h) wherein either the first and second webs are calendered individually prior to combination into a multi-ply web or the multi-ply web is calendered;

(i) wherein the multi-ply web is sprayed with a softener to result in a web containing at least about 1.0 lb/ton of softener; and wherein steps (a)–(f), (h) and (i) are controlled to result in a multi-ply tissue product having an MD tensile strength of about 27 to about 38 g/3" width per lb. of basis weight, a CD tensile strength of about 10 to about 23 g/3" width per lb. of basis weight, a caliper of at least about 3 mils/lb. basis weight, a GM MMD friction of less than about 0.190, and a tensile stiffness of less than about 0.72 g/% strain per lb. of basis weight.

DETAILED DESCRIPTION

Figure 3:
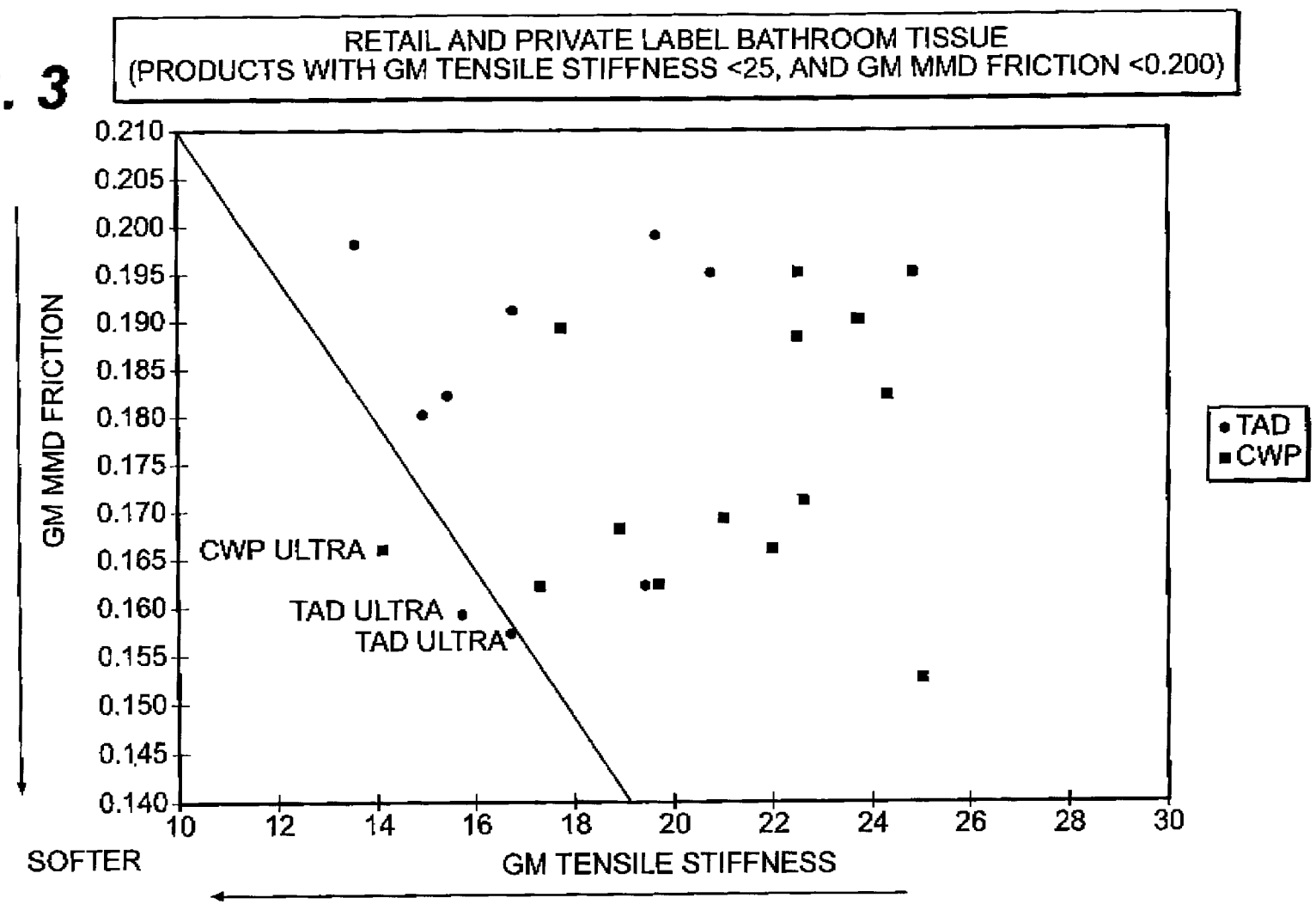
FIG. 3 illustrates the relationship between GM Tensile Stiffness and GM MMD Friction.

The present invention relates to the production of an ultra-soft, high basis weight multi-ply tissue. As used herein, high basis weight refers to a product (one or more plies) having a basis weight of 22 or more lbs per 3000 sq. ft.ream. As used herein ultra-soft refers to a product below the line ranging from (GM Tensile Stiffness) GMTS=19 and GM MMD=0.140 and GMTS=10 and GMM MD=210. Above this line a product would be labelled soft but not ultra soft. The relationship between GMTS and GM MMD and the afore-mentioned line are set forth in FIG. 3.

The pulp used to produce the web of the present invention comprises between 35% and 90% of a first fiber and between 65% and 10% of a second fiber. The first fiber is characterized as a short fiber with an average fiber length of 2.0 mm or less and a coarseness of less than about 12 mg/100 meters. The second fiber is characterized as a long fiber with an average fiber length of more than 2.0 mm and a coarseness of less than about 35 mg/100 meters. The second fibers preferably have a coarseness below 20 mg/100 meters and most preferably have a coarseness below 18 mg/100 meters.

The first fiber is preferably selected from substantially unrefined, short, low-coarseness fibers. As used in the present invention, low-coarseness is preferably below 12 mg/100 meters. A complete discussion of coarseness can be found for example in Kajaani Electronics Ltd., *The Significance of Coarseness in Papermaking*, Kajaani Finland, 1986. These low-coarseness fibers are preferably selected from eucalyptus fibers or other hardwoods; mixtures of eucalyptus fibers and other hardwood fibers; mixtures of hardwood fibers or eucalyptus fibers with other low-coarseness fibers, more preferably with a lower coarseness than that of eucalyptus fiber; and mixtures of the foregoing. Preferred fibers for use as the first fiber are eucalyptus fiber and northern hardwood kraft fiber. Other low-coarseness fibers which may be used in combination with eucalyptus fibers include non-woody plant fibers such as those disclosed in U.S. Pat. Nos. 5,320,710 and 3,620,91 1, both of which are incorporated herein by reference.

Preferred first fiber is selected from northern hardwood fibers which have been dried in accordance with the copending application filed concurrently herewith by the assignee of the present application (Serial No. to be supplied upon receipt) and eucalyptus fiber.

The second fiber is preferably selected from substantially unrefined, long, high-strength fibers. As used in the present invention long fibers are those having an average fiber length of at least 2.0 mm. Strength is usually expressed as the length at which a strip of paper will break under its own weight. Papers made with high-strength fibers typically have a breaking length of at least 12 km, more preferably at least 14 km. These fibers are preferably selected from softwood kraft fibers, preferably northern softwood kraft fibers; mixtures containing as a major portion northern softwood kraft fibers; low-coarseness softwood kraft fibers having a comparable or lower coarseness than that of northern softwood kraft fibers which is typically between 14 and 20 mg/100 meters; and mixtures of the foregoing.

The product of the present invention can be prepared as a stratified or non-stratified product. In one embodiment, the product is prepared as a non-stratified product, however, exhibiting the characteristics of high softness and bulk. A stratified product may be produced according to the present invention, but if a stratified product is produced, the amount of hardwood kraft fiber may be reduced.

The pulp can be mixed with strength-adjusting agents such as starches, debonders, and mixtures thereof. The pulp preferably contains up to about 10 lbs/ton of one or more strength adjusting agents, more preferably up to about 5 lbs/ton, still more preferably 2 to 3 lbs. The strength adjusting agents are preferably selected from Solvitose N Starch® Reilly-Whiteman DB-170® debonder; Westcat PG; Redibond; and Quasoft 202 JR®, 218®, and 206® Varisoft 475® from Quaker Chemicals.

In many cases, particularly when a stratified machine is used, starches and debonders can be advantageously used simultaneously. In other cases starches, debonders or mixtures thereof may be supplied to the wet end while debonders may be applied by spraying.

Suitable debonders, however, will be readily apparent to the skilled artisan. Suitable debonders are widely described in the patent literature. A comprehensive but non-exhaustive list includes U.S. Pat. Nos. 4,795,530; 5,225,047; 5,399,241; 3,844,880; 3,554,863; 3,554,862; 4,795,530; 4,720,383; 5,223,0965,262,007; 5,312,522; 5,354,425; 5,145,737, and EPA 0 675 225 each of which is specifically incorporated herein by reference in its entirety.

The web may further include temporary strength agents. Typical temporary strength adjusting agents are well known to the skilled artisan and the method and amounts for their effective use are also understood by the skilled artisan. Typical temporary wet strength agents which may be used in the present invention include, but are not limited to glyoxal and modified starches.

The amount of strength adjusting agent is preferably provided to control the machine direction (MD) strength of the multiple-ply web to from about 32 to about 38 g/3" strip/lb. basis weight after embossing. Preferably the strength-control agent is added in an amount up to about 5 lbs/ton, more preferably less than 4 lbs/ton, most preferably between 3 and 4 lbs/ton.

The MD tensile strength (g/3" width per lb. basis weight) is preferably from about 27 to about.38, more preferably about 30 to 35. The CD tensile strength (g/3" width per lb. basis weight) is preferably from about 10 to about 16, more preferably from about 12 to about 14. Throughout this application, by basis weight, we mean basis weight in pounds per 3000 square ft. ream of the web. Many of the values provided throughout the specification have been normalized.

A first nascent web is then formed from the pulp. The web can be formed using any of the standard wet-press configurations known to the skilled artisan, e.g., crescent former, suction breast roll, twin-wire former, etc. Once the web is formed, it preferably has a basis weight, under TAPPI LAB CONDITIONS of at least about 11 lbs/3000 sq. ft. ream, preferably at least about 13.5 lbs/3000 sq. ft. ream, more preferably at least about 12–14 lbs/3000 sq. ft. ream. TAPPI LAB-CONDITIONS refers to TAPPI T-402 test methods specifying time, temperature and humidity conditions for a sequence of conditioning steps.

After the web is formed, it can be sprayed with from at least about 1.0 to about 3.5 lbs/ton of softener, more preferably about 1.5 to about 3.5 lbs/ton of softener. Alternatively, a softener may be incorporated into the wet end of the process to result in a web including at least about 1.0 lbs/ton of softener. It will be understood by the skilled artisan that spraying of the softener may occur after two webs have been joined to form a two-ply product.

The softener may be either cationic or non-cationic. The softener is preferably a cationic nitrogenous softener. The softener is preferably selected from trivalent and tetravalent cationic organic nitrogen compounds incorporating long fatty acid chains; compounds including imidazolines, amino acid salts, linear amine amides; tetravalent or quaternary ammonium salts; mixtures of the foregoing. More particularly, the softener may be Quasoft 202 JR®, 218 ®, 209® and 219®, and Varisoft 475® from Quaker Chemical.

The web is then dewatered preferably by an overall compaction process. The web is then preferably adhered to a Yankee dryer. Any suitable art recognized adhesive may be used on the Yankee dryer. Preferred adhesives include Houghton 8290 (H8290) adhesive, Houghton 82176 (H82176) adhesive, Quacoat A-252 (QA252), Betz creplus 97 (Betz+97), Calgon 675 B. Suitable adhesives are widely described in the patent literature. A comprehensive but non-exhaustive list includes U.S. Pat. Nos. 5,246,544; 4,304,625; 4,064,213; 4,501,640; 4,528,316; 4,883,564; 4,684,439; 4,886,579; 5,374,334; 5,382,323; 4,094,718; and 5,281,307. Typical release agent can be used in accordance with the present invention; however, the amount of release, should one be used at all, will often be below traditional levels.

The web is then creped from the Yankee dryer and calendered. The adhesion between the web and the Yankee dryer is preferably controlled to such a level that a reel crepe of at least about 20%, more preferably 24% and most preferably 25% is maintained. Creping is preferably carried out at a creping angle of from about 70° to about 88°, preferably about 73° to about 85° and more preferably about 80°. The crepe blade bevel angle is preferably about 0° to about 15°, more preferably about 10°.

The product of the present invention is a soft bulky tissue which can be made on a non-stratified machine. The skilled artisan would understand that a stratified product can be formed using lower proportions of hardwood kraft than on a non-stratified product. The product according to the present invention is preferably a multi-ply product. Two or more plys of tissue are adhered to one another preferably by embossing and perforating the two plys together. The embossments and perforations usually account for adhesion. The two plies may be adhered using an adhesive either alone or in conjunction with an embossing pattern. Suitable adhesives are well known and will be readily apparent to the skilled artisan. The two plies are preferably embossed together with adhesive being applied only to the tips of the emboss elements. A secon ply may be formed in the same manner as the first ply.

The calendering and embossing of the webs preferably combines to form a multi-ply web having a specific caliper of the multi-ply web of at least about 3.0 mils/ lb. basis weight, more preferably from about 3.0 to about 4.2 mils/lb basis weight and most preferably 3.2 to 3.8 mils/lb basis weight. The GM MMD of the multiply web is preferably no more than about 0 190, is more preferably less than about 0.180, and is most preferably about 0.150 to about 0.175. The tensile stiffness of the web is preferably less than 0.72 g/% strain per pound of basis weight and more preferably at or less than about 0.58 g/% strain per pound of basis weight, most preferably less than about 0.51 g/% strain per pound of basis weight.

Figure 1:
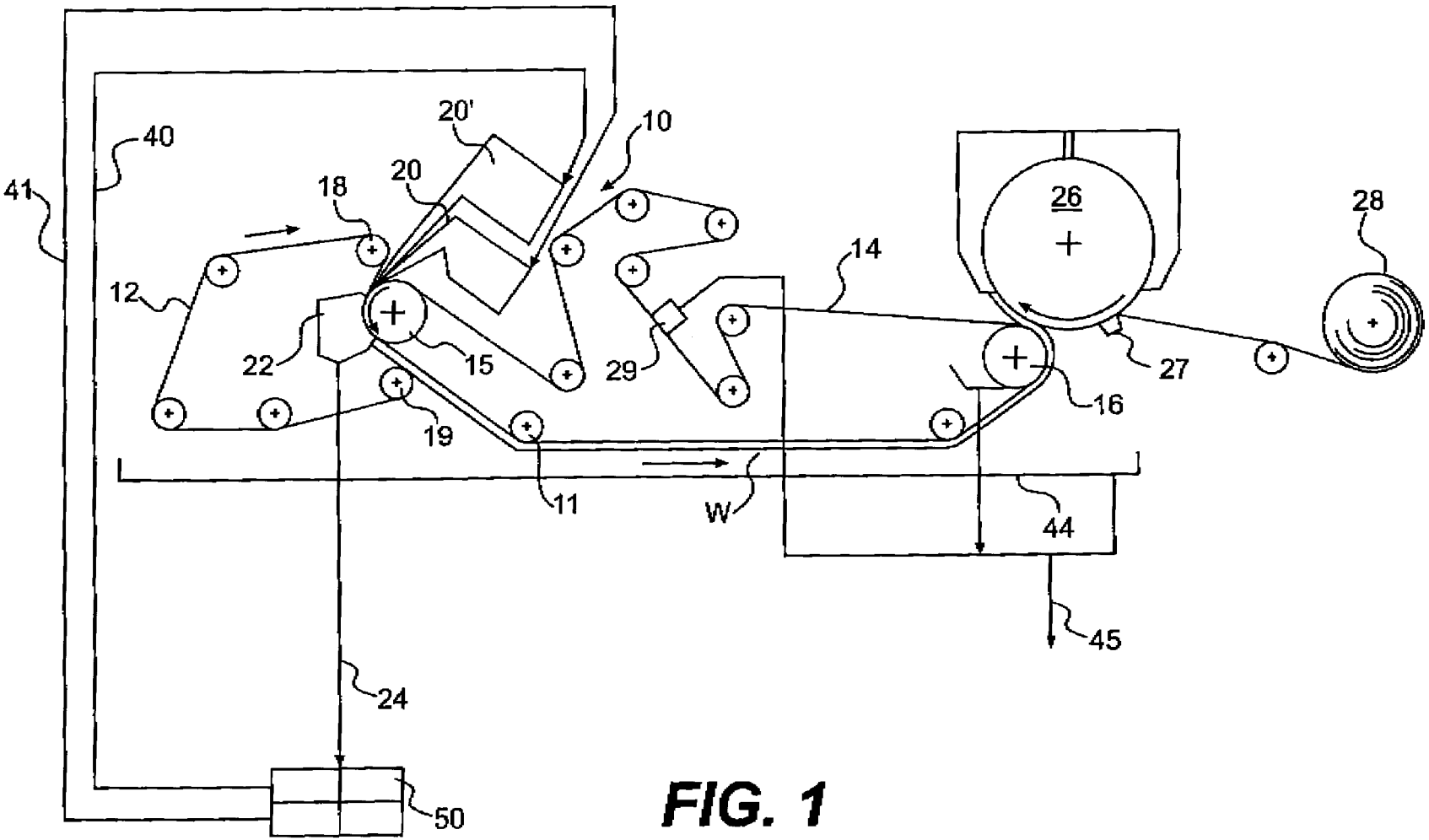
FIG. 1 illustrates a preferred wet press processing apparatus.
Figure 2:
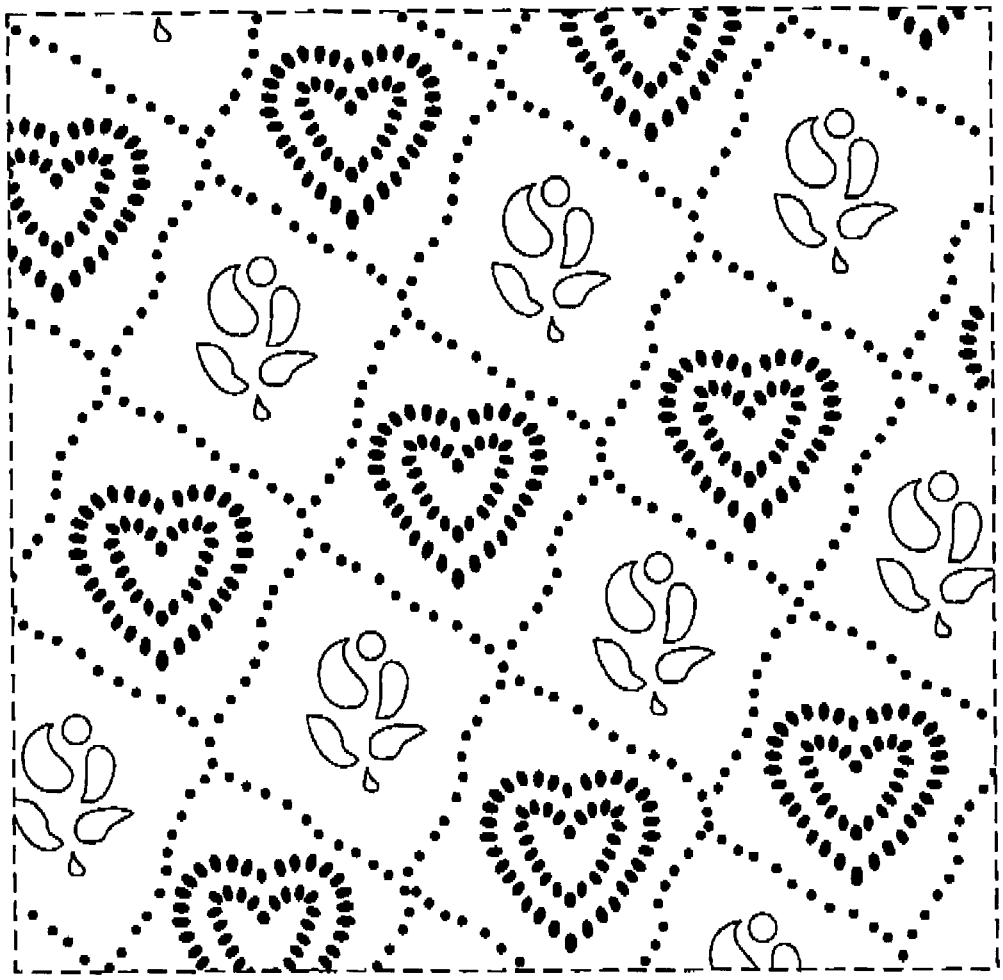
FIG. 2 illustrates a preferred emboss pattern for use in the present invention.

The web may be embossed with any art-recognized embossing pattern. One preferred emboss pattern is made up of a wavy pattern, e.g. lattice of dot shaped bosses having either hearts, flowers or both within the separation areas of the pattern. FIG. 2 is a depiction of a preferred emboss pattern for use with the present invention. It is also preferred that the emboss pattern of the present invention be formed of crenulated emboss elements. A crenulated emboss element is one that has a wide base with smaller separated land areas at the apex, resembling for example the top of a castle wall. Such an emboss pattern further enhances the tissue bulk and softness. The emboss element heights are preferably less than 90 thousandths of an inch, more preferably less than 70 thousandths of an inch and most preferably 50 to 70 thousandths of an inch.

The following examples are not to be construed as limiting the invention as described herein.

EXAMPLE 1

A nascent web was formed from a combination of 65% eucalyptus fibers and 35% northern softwood kraft fibers. The pulp used to form the web also contained 1.0 lbs/ton of Quasoft 218 as a strength-adjusting agent. The web was sprayed with 1.8 lbs/ton of Quasoft 218 as a softener. The treated web was then dewatered by overall compaction and adhered to the Yankee dryer. Houghton 82176 and 564 were used as the Yankee dryer adhesive and release. The web was creped from the Yankee dryer and calendered. The reel speed was 3481 feet per minute. A reel crepe of 24.3% was maintained during creping.

A second web was formed in the same manner and combined with the first web by embossing a heart/flower/lattice pattern as depicted in FIG. 2. The resultant multiply sheet had the following properties:

A roll of 170 sheets was formed from the multi-layer product described above. The 170-sheet-count roll has the following characteristics per lb of basis weight:

33.7 MD strength g/3"

13.0 CD strengthg/3"

26.6 basis weight 3000 sq. ft. ream 3.87 specific caliper mils/8 sheets 0.159 GM MMD 0.50 tensile stiffness g/% strain The product attributes differ slightly when a 340 sheet count product is formed. These differences are generally due to a decrease in the amount of embossing that is used, since the need for added bulk is reduced in a 340-sheet-count product. The caliper of a typical 340 sheet count product was about 3.2 mils/8 sheet count per lb of basis weight while the specific tensile stiffness was about 0.68 and the GM MMD was about 0.170.

EXAMPLES 2–16

Examples 2–16 were carried out in the same manner as Example 1, with the processing conditions and product attributes as set forth in the Table below.

TABLE 1

| Example No. | Pulp Type and Amount | Homo or Stratified | Percent Crepe | Yankee Adhesive | Softener and Amount | Strength Adjust and Amt | Crepe Angle | Blade Bevel | Basis Weight |
|---|---|---|---|---|---|---|---|---|---|
| 1 | 65 Euc/35 SWK | H | 24.3 | H82176 | Q218 1.8 lbs/ton | Q218 1.0 lb/ton | 75 | 15 | 26.6 |
| 2 | 50 EUC/50 SWK | H | 25.0 | H82176 | Q218 2.5 lbs/ton | Q206 2–3 lb/ton | 78 | 12 | 26.5 |
| 3 | 65 Euc/35 SWK | H | 25.0 | H82176 | Q218 2.5 lbs/ton | Q206 2–3 lb/ton | 78 | 12 | 26.4 |
| 4 | 65 Euc/35 SWK | H | 25.0 | H82176 | Q218 2.5 lbs/ton | Q206 2–3 lb/ton | 78 | 12 | 26.5 |
| 5 | 65 Euc/35 SWK | H | 20.6 | Betz + 98 | Q218 2 lbs/ton | — | 73 | 17 | 27.0 |
| 6 | 65 Euc/35 SWK | H | 22.0 | Betz + 97 | Q218 2 lbs/ton | — | 73 | 17 | 26.4 |
| 7 | 65 Euc/35 SWK | H | 23.0 | Betz + 97 | Q218 2.5 lbs/ton | — | 73 | 17 | 27.8 |
| 8 | 35 Euc/65 SWK | S | 25.0 | H8290 | Q202IR 3.5 lbs/ton | Q202IR 7.0 lb/ton | 82 | 18 | 23.7 |
| 9 | 69 HWK/31 SWK | H | 25.1 | H82176 | Q218 2.2 lbs/ton | Q206 1.5 lb/ton | 80 | 15 | 26.1 |
| 10 | 70 Euc/30 SWK | H | 25.0 | H82176 | Q218 2.5 lbs/ton | Q206 1.0 lb/ton | 80 | 15 | 26.1 |
| 11 | 68 Euc/32 SWK | H | 25.0 | H82176 | Q218 2.4 lbs/ton | Q206 1.0 lb/ton | 80 | 15 | 25.6 |
| 12 | 65 Euc/35 SWK | H | 25.0 | QA252 | Q218 1.5 lbs/ton | westcatPG 2.5 lb/ton | 75 | 15 | 26.3 |
| 13 | 60 Euc/40 Hemlock | H | 25.0 | QA252 | Q218 1.5 lbs/ton | westcatPG 5.5 lb/ton | 75 | 15 | 26.8 |
| 14 | 60 Euc/40 Hemlock | H | 25.0 | QA252 | Q218 1.5 lbs/ton | westcatPG 3.5 lb/ton | 75 | 15 | 26.8 |
| 15 | 65 Euc/35 SWK | S | 24.3 | H82176 | Q218 1.4 lbs/ton | Q218 1.0 lb/ton | 75 | 15 | 26.0 |
| 16 | 80 Euc/20 SWK | — | — | — | — | — | — | — | 27.1 |

| Example No. | Blade Bevel | Caliper mils/lb | MD Tensile per lb. | CD Tensile per lb. | MD Stretch | Perf. Tensile | GM MMD Friction | Tensile Stiffness per lb. |
|---|---|---|---|---|---|---|---|---|
| 1 | 0 | 3.9 | 34 | 13 | 22.2 | 344 | 0.159 | 0.50 |
| 2 | 0 | 3.6 | 32 | 11 | 20.0 | 325 | 0.158 | 0.56 |
| 3 | 0 | 3.7 | 30 | 12 | 19.2 | 334 | 0.166 | 0.54 |
| 4 | 0 | 3.3 | 28 | 11 | 20.4 | 370 | 0.155 | 0.58 |
| 5 | 0 | 3.8 | 36 | 13 | 19.7 | 365 | 0.176 | 0.57 |
| 6 | 0 | 3.8 | 34 | 12 | 16.8 | 315 | 0.170 | 0.52 |
| 7 | 0 | 3.6 | 33 | 14 | 18.9 | 359 | 0.165 | 0.60 |
| 8 | 10 | 3.6 | 34 | 23 | 24.0 | 315 | 0.144 | 0.72 |
| 9 | 5 | 3.7 | 30 | 12 | 19.3 | 350 | 0.178 | 0.43 |

TABLE 1-continued

| | | | | | | | | |
|---|---|---|---|---|---|---|---|---|
| 10 | 5 | 3.6 | 38 | 14 | — | 362 | 0.174 | 0.50 |
| 11 | 5 | 3.7 | 29 | 11 | 21.4 | 304 | 0.170 | 0.41 |
| 12 | 0 | 3.7 | 33 | 13 | 19.3 | 323 | 0.169 | 0.52 |
| 13 | 0 | 3.6 | 33 | 15 | 19.5 | 388 | 0.179 | 0.58 |
| 14 | 0 | 3.6 | 33 | 15 | 18.8 | 358 | 0.172 | 0.57 |
| 15 | 0 | 3.8 | 34 | 15 | 18.8 | 358 | 0.172 | 0.57 |
| 16 | — | 3.9 | 30 | 14 | — | 383 | 0.174 | 0.51 |

Other embodiments of the invention will be apparent to those skilled in the art from consideration of the specification and practice of the invention disclosed herein. It is intended that the specification and examples be considered as exemplary only, with the true scope and spirit of the invention being indicated by the following claims.

We claim:

1. A method of making an ultra-soft high basis weight multi-ply tissue comprising:

(a) providing a fibrous pulp including 35 to 90% of a first fiber, wherein said first fiber has an average fiber length of 2.0 mm or less and a coarseness of 12 mg/100 meters or less;

and including 10 to 65% of a second fiber having an average fiber length greater than 2.0 mm and a coarseness of less than 35 mg/100 meters wherein said pulp further includes up to about 5 lb/ton of a strength adjusting agent;

(b) forming a first nascent web from said pulp, wherein said first web has a basis weight of at least about 11 lbs/3000 sq. ft. ream;

(c) including in said first web at least about 1.0 lbs/ton of a cationic nitrogenous softener;

(d) dewatering said first web through wet pressing;

(e) adhering said first web to a Yankee dryer;

(f) creping said first web from said Yankee dryer, wherein the adhesion between said first web and said Yankee dryer is controlled to achieve a reel crepe of at least about 20%;

(g) forming a second nascent web as recited in steps (a)–(f) above;

(h) combining said first web with said second web to form a multi-ply web;

(i) wherein either said first and second webs are calendered individually prior to combination into a multi-ply web or said multi-ply web is calendered; and wherein steps (a)–(f), (g) and (i) are controlled to result in a multi-ply tissue product having an MD tensile strength of about 27 to about 38 g/3" width per lb. of basis weight, a CD tensile strength of about 10 to about 23 g/3" width per lb. of basis weight, a caliper of at least about 3 mils/lb. basis weight, a GM MMD friction of less than about 0.190, and a tensile stiffness of less than about 0.72 g/% strain per lb. of basis weight.

2. The method according to claim 1, wherein said second fiber has a coarseness of less than 20 mg/100 meters.

3. The method according to claim 1, wherein said first fibers are selected from eucalyptus fibers or other hardwood fibers; mixtures of eucalyptus fibers and North American hardwood fibers; mixtures of hardwood fibers or eucalyptus fibers with other low-coarseness fibers, and mixtures of the foregoing.

4. The method according to claim 1, wherein said second fibers are selected from softwood kraft fibers, northern softwood kraft fibers, mixtures containing as a major portion northern softwood kraft fibers, low-coarseness softwood kraft fibers having lower coarseness than that of northern softwood kraft fibers, and mixtures of the foregoing.

5. The method according to claim 1, wherein the cationic nitrogenous softener is included by spraying said softener onto said web.

6. The method according to claim 1, wherein the cationic nitrogenous softener is selected from the group consisting of trivalent and tetravalent organic nitrogen compounds incorporating long chain fatty acids; imidazolines; amino acid salts, linear amine amides; quaternary ammonium salts and mixtures thereof.

7. The method according to claim 1, wherein the basis weight of said web is at least about 13.0 lbs/3000 sq. ft. ream.

8. The method according to claim 1, wherein the starches and debonders are selected from the group consisting of Solvitose N Starch®; Reilly-Whiteman DB-170® debonder; Westcat PG; Redibond; Quasoft 202 JR®, 218®, and 206® and Varisoft 475®.

9. The method according to claim 1, wherein said strength adjusting agent is added in an amount effective to control the MD tensile strength of said multi-ply web to from about 30 to about 35 g/3" width per pound of basis weight.

10. The method according to claim 1, wherein said multi-ply web has a CD tensile strength of from about 12 to about 14 g/ 3" width/lb basis weight.

11. The method according to claim 1, wherein said multi-ply web has a specific caliper of at least about 3.2 mils/lb basis weight.

12. The method according to claim 1, wherein said multi-ply web has a GM MMD of not more than about 0.175.

13. The method according to claim 1, wherein said multi-ply web has a tensile stiffness of not more than about 0.58.

14. The method according to claim 13, wherein the tensile stiffness is less than about 0.51.

15. The method according to claim 1, wherein each of said first and second webs are calendered individually.

16. The method according to claim 1, wherein said multi-ply web is calendered.

17. The method according to claim 1, wherein said webs further include a temporary wet strength agent.

18. The method according to claim 1, wherein said combined webs are embossed with a wavy pattern of dot shaped bosses having hearts, flowers or both within the separation areas of the pattern.

19. The method according to claim 1, wherein said combined webs are embossed with crenulated emboss elements.

20. A multi-ply tissue product produced according to the method of claim 1.

21. A multi-ply tissue product comprising at least two paper webs each having a basis weight of at least about 11 lbs/3000 sq. ft. ream, each of said at least two webs including at least about 1.0 lbs/ton of a cationic nitrogenous softener and said multi-ply tissue product having an MD tensile strength of about 27 to about 38 g/3" width per lb. of basis weight, a CD tensile strength of about 10 to about 16 g/3" width per lb. of basis weight, a caliper of at least about 3 mils/lb. basis weight, a GM MMD friction of less than about 0.190, and a tensile stiffness of less than about 0.68 g/% strain per lb. of basis weight.

22. A method of making an ultra-soft high basis weight multi-ply tissue comprising:

(a) providing a fibrous pulp including 35 to 90% of a first fiber, wherein said first fiber has an average fiber length of 2.0 mm or less and a coarseness of 12 mg/100 meters or less;

and including 10 to 65% of a second fiber having an average fiber length greater than 2.0 mm and a coarseness of less than 35 mg/100 meters wherein said pulp further includes up to about 5 lb/ton of a strength adjusting agent;

(b) forming a first nascent web from said pulp, wherein said first web has a basis weight of at least about 11 lbs/3000 sq. ft. ream;

(c) dewatering said first web through wet pressing;

(d) adhering said first web to a Yankee dryer;

(e) creping said first web from said Yankee dryer, wherein the adhesion between said first web and said Yankee dryer is controlled to achieve a reel crepe of at least about 20%;

(f) forming a second nascent web as recited in steps (a)–(f) above;

(g) combining said first web with said second web to form a multi-ply web;

(h) wherein either said first and second webs are calendered individually prior to combination into a multi-ply web or said multi-ply web is calendered;

(i) wherein said multi-ply web is sprayed with a softener to result in a web containing at least about 1.0 lb/ton of softener; and wherein steps (a)–(f), (h) and (i) are controlled to result in a multi-ply tissue product having an MD tensile strength of about 27 to about 38 g/3' width per lb. of basis weight, a CD tensile strength of about 10 to about 23 g/3" width per lb. of basis weight, a caliper of at least about 3 mils/lb. basis weight, a GM MMD friction of less than about 0.190, and a tensile stiffness of less than about 0.72 g/% strain per lb. of basis weight.

* * * * *

UNITED STATES PATENT AND TRADEMARK OFFICE

CERTIFICATE OF CORRECTION

PATENT NO. : 6,419,790 B1
DATED : July 16, 2002
INVENTOR(S) : Joseph C. Leege et al.

It is certified that error appears in the above-identified patent and that said Letters Patent is hereby corrected as shown below:

Column 12,
Line 17, "38 g/3' " should read -- 38 g/3" --.

Signed and Sealed this

Third Day of December, 2002

JAMES E. ROGAN
*Director of the United States Patent and Trademark Office*